US008967685B2

(12) United States Patent
Liao

(10) Patent No.: US 8,967,685 B2
(45) Date of Patent: Mar. 3, 2015

(54) ELECTROMAGNETIC DOORLOCK WITH BUTTON DETECTION AND POWER SAVING DEVICE

(71) Applicant: Li-Shih Liao, Taoyuan County (TW)

(72) Inventor: Li-Shih Liao, Taoyuan County (TW)

( * ) Notice: Subject to any disclaimer, the term of this patent is extended or adjusted under 35 U.S.C. 154(b) by 87 days.

(21) Appl. No.: 13/774,196

(22) Filed: Feb. 22, 2013

(65) Prior Publication Data

US 2013/0229020 A1 Sep. 5, 2013

(30) Foreign Application Priority Data

Mar. 2, 2012 (TW) ..... 101203736 U

(51) Int. Cl.
*E05C 19/16* (2006.01)
*E05B 63/00* (2006.01)
*E05B 47/00* (2006.01)

(52) U.S. Cl.
CPC ..... *E05C 19/166* (2013.01); *E05B 63/0056* (2013.01); *E05B 2047/0066* (2013.01); *Y10S 292/65* (2013.01)
USPC ..... 292/251.5; 292/DIG. 65

(58) Field of Classification Search
USPC ..... 292/92–94, 251.5, DIG. 65
See application file for complete search history.

(56) References Cited

U.S. PATENT DOCUMENTS 4,652,028 A * 3/1987 Logan et al. ..... 292/251.5
2011/0018680 A1* 1/2011 Lai et al. ..... 340/3.1

* cited by examiner

*Primary Examiner* — Kristina Fulton
*Assistant Examiner* — Christine M Mills
(74) *Attorney, Agent, or Firm* — Rosenberg, Klein & Lee

(57) ABSTRACT

An electromagnetic doorlock with button detection and power saving device includes an electromagnet assembly and a corresponding adsorption assembly. The electromagnet assembly is connected to a button detection module and the adsorption assembly has a pressing member to abut the button detection module. When the door is closed, the electromagnet assembly with electromagnetic attraction attracts the adsorption assembly and the pressing member presses the button detection module. That is, the electromagnetic doorlock usually stays in a low-energy attraction state; however, when the button detection module is triggered, the electromagnetic doorlock returns to a normal lock state for achieving power saving effect and control of the external force detection improvement.

12 Claims, 14 Drawing Sheets

ELECTROMAGNETIC DOORLOCK WITH BUTTON DETECTION AND POWER SAVING DEVICE

BACKGROUND OF THE INVENTION

1. Field of the Invention

The invention relates to an electromagnetic doorlock, particularly to the electromagnetic doorlock with button detection and power saving device.

2. Description of the Related Art

In the access control monitoring system, the use of an electromagnetic door lock has been very popular. The electromagnetic door lock 10 as shown in FIG. 1 discloses an electric magnet 11 mounted on a door frame 13 and an adsorption plate 12 mounted on a corresponding position of a door plate 14. When the electric magnet 11 is energized to produce electromagnetic attraction to attract the adsorption plate 12, the electromagnetic door lock 10 forms a lock state. When the electric magnet 11 is de-energized and the adsorption plate 12 detaches from the electric magnet 11, the electromagnetic door lock 10 then forms in an unlock state. The above features are disclosed in U.S. Pat. No. 4,652,028.

Normally, the power consumption of the electromagnetic door lock 10 of the DC power is about tens of watts. If 12 volts of DC power is supplied, the consumption current maintains hundreds of mill-amperes (mA); thus, the electromagnetic door lock 10 requires a lot of electrical energy.

It is considerable that the safety monitoring system of the electromagnetic door lock requires practical applicability and controllability; therefore, energy saving design requires further improvement.

SUMMARY OF THE INVENTION

It is a primary object of the present invention to provide an electromagnetic doorlock with button detection and power saving device, which usually stays in a low-energy adsorption state; however, when a button detection module is triggered, the electromagnetic doorlock returns to normal lock state for achieving power saving and access control security effects.

It is a second object of the present invention to provide an electromagnetic doorlock with button detection and power saving device having an adsorption plate with buffering displacement design for an electric magnet to have sufficient time to resume operation to ensure the security of access control.

In order to achieve the above objects, the present invention includes an electromagnetic doorlock with button detection and power saving device according to claim 1.

Based on the features disclosed, the button detection module further includes an elastic member arranged on the flexible body, an abutment body arranged on the elastic member and having a protrusion portion and a positioning flange at a periphery thereof and a seat fixed on the base and having an axial through hole for containing the abutment body and axially telescoping to provide an upward elastic force for the abutment body by the elastic member.

Further, the electromagnet assembly is arranged on a door frame and the adsorption assembly is correspondingly arranged on the door plate; the electromagnet assembly has a containing room with a cover at an opening thereof; the cover has a mounted hole thereon and the button detection module is mounted on the mounted hole.

Further, the seat of the button detection module has a positioning surface at a periphery of the axial through hole for the positioning flange to be abutted when the protrusion portion of the abutment body is upward pushed by the elastic member.

Further, the pressing member includes: a base body having a recessed surface with a second screw hole at a center thereof and an abutment button having a front side facing to the abutment body of the button detection module and a bottom surface with a second screw for screwing to the second screw hole to adjust a height between the abutment button and a surface of the base body.

DETAILED DESCRIPTION OF THE PREFERRED EMBODIMENT

Figure 6:
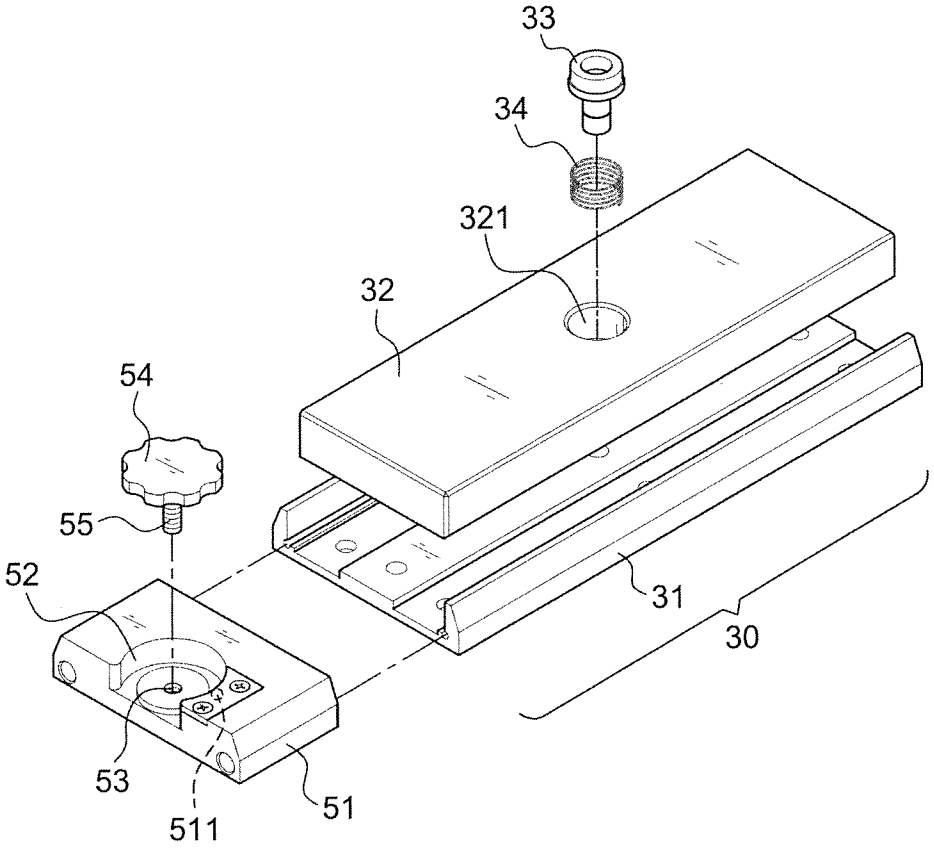
FIG. 6 is a perspective view of the present invention, illustrating the disassembly of the adsorption assembly and pressing member.
Figure 7:
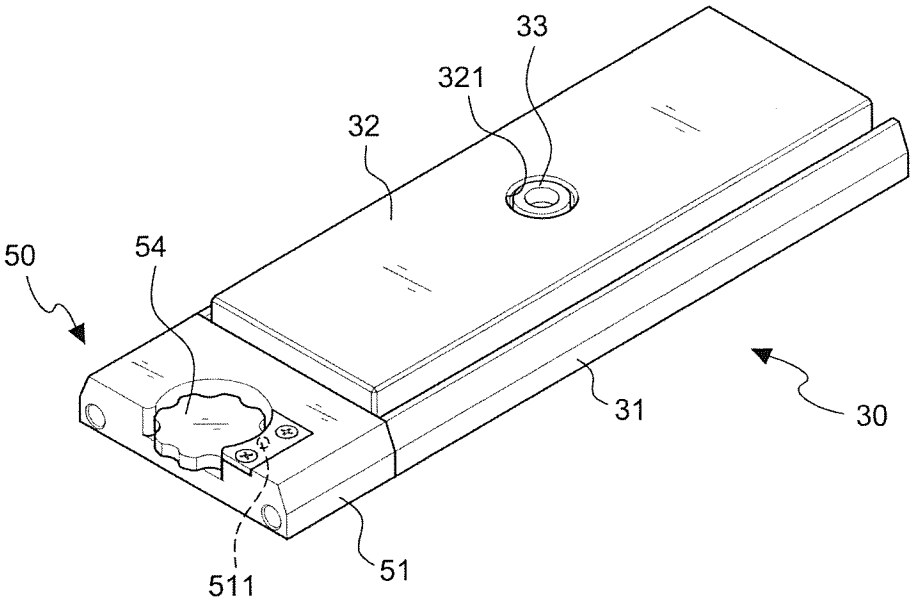
FIG. 7 is a perspective view of the present invention, illustrating the assembly of the adsorption assembly and pressing member.
Figure 8:
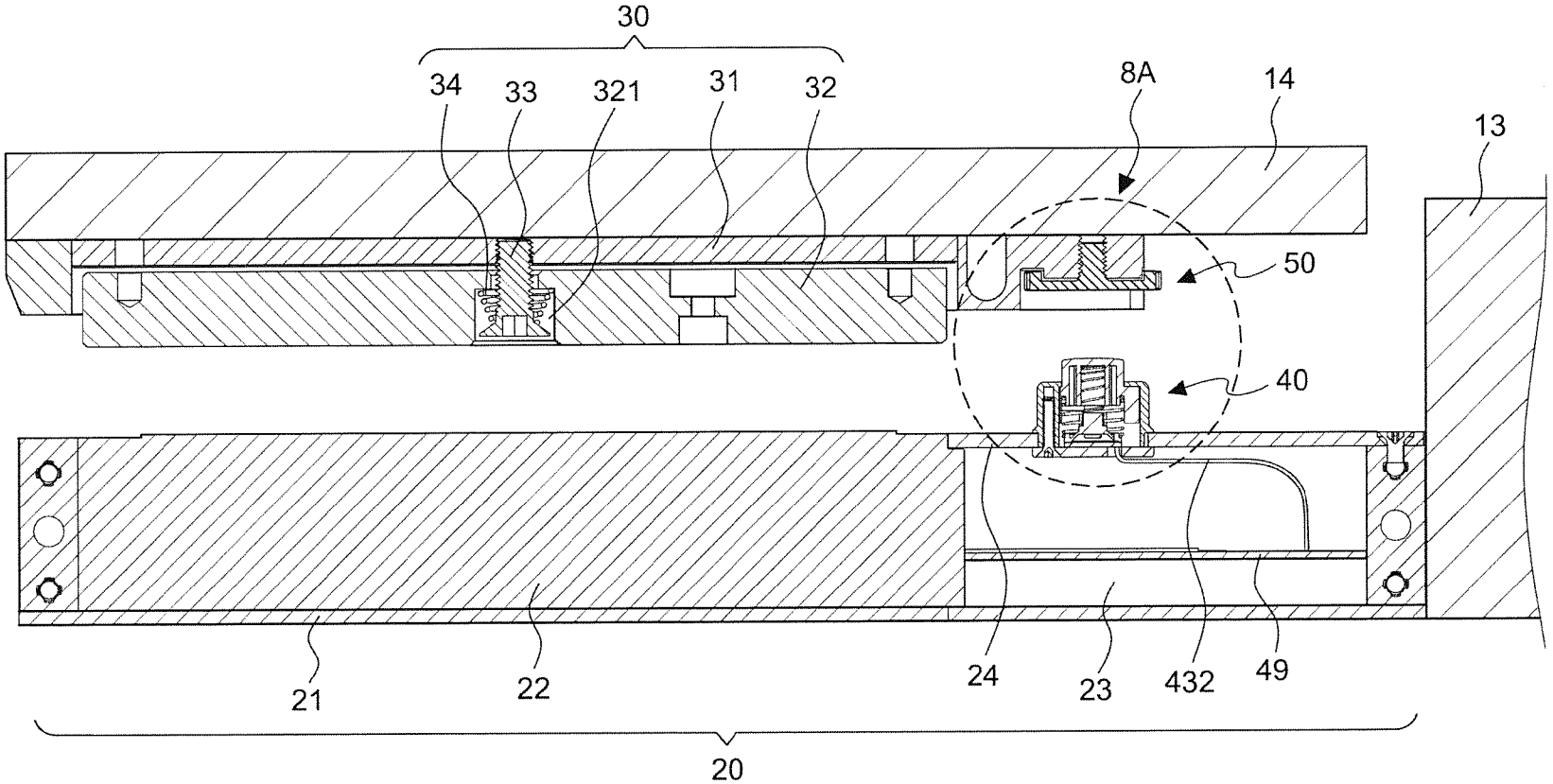
FIG. 8 is a sectional view of the present invention, illustrating the separation of the electromagnet assembly and adsorption assembly.
Figure 9:
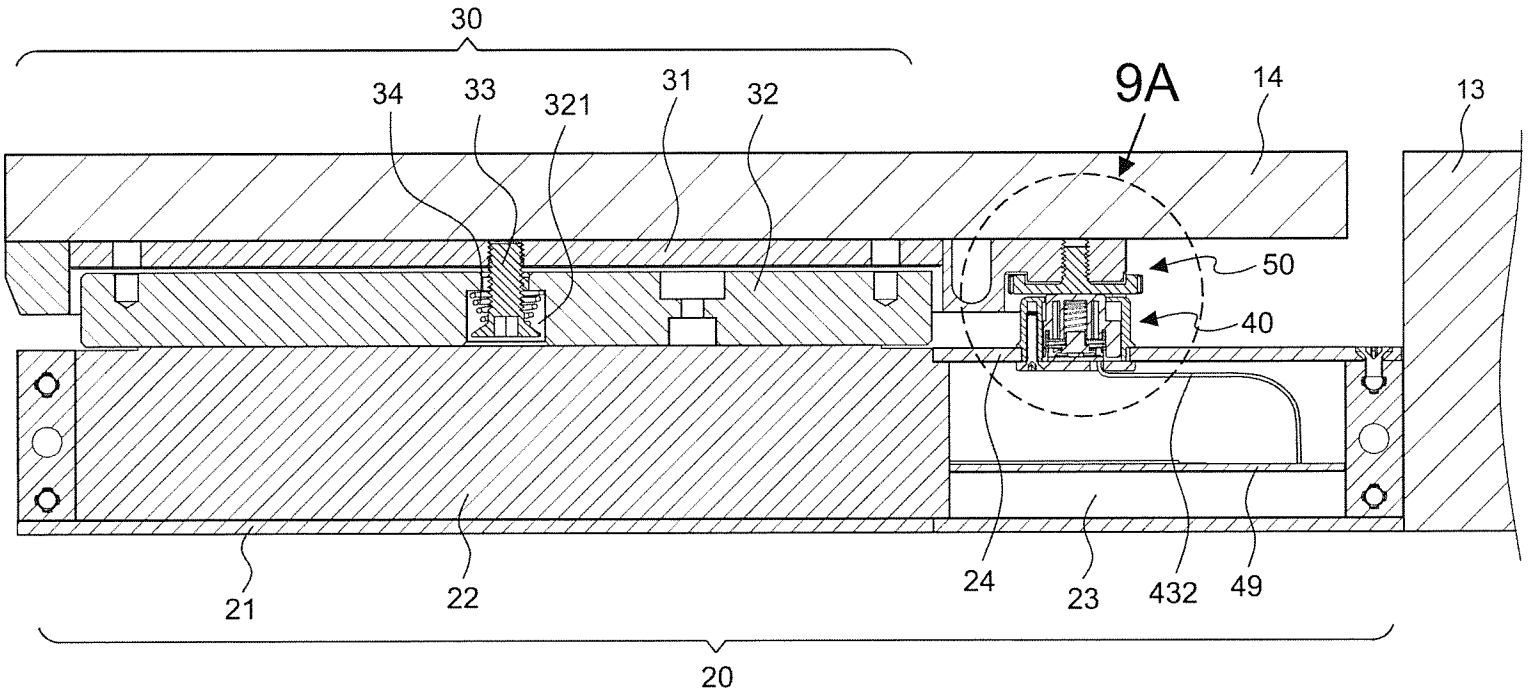
FIG. 9 is a sectional view of the present invention, illustrating the abutment of the electromagnet assembly and adsorption assembly.
Figure 9A:
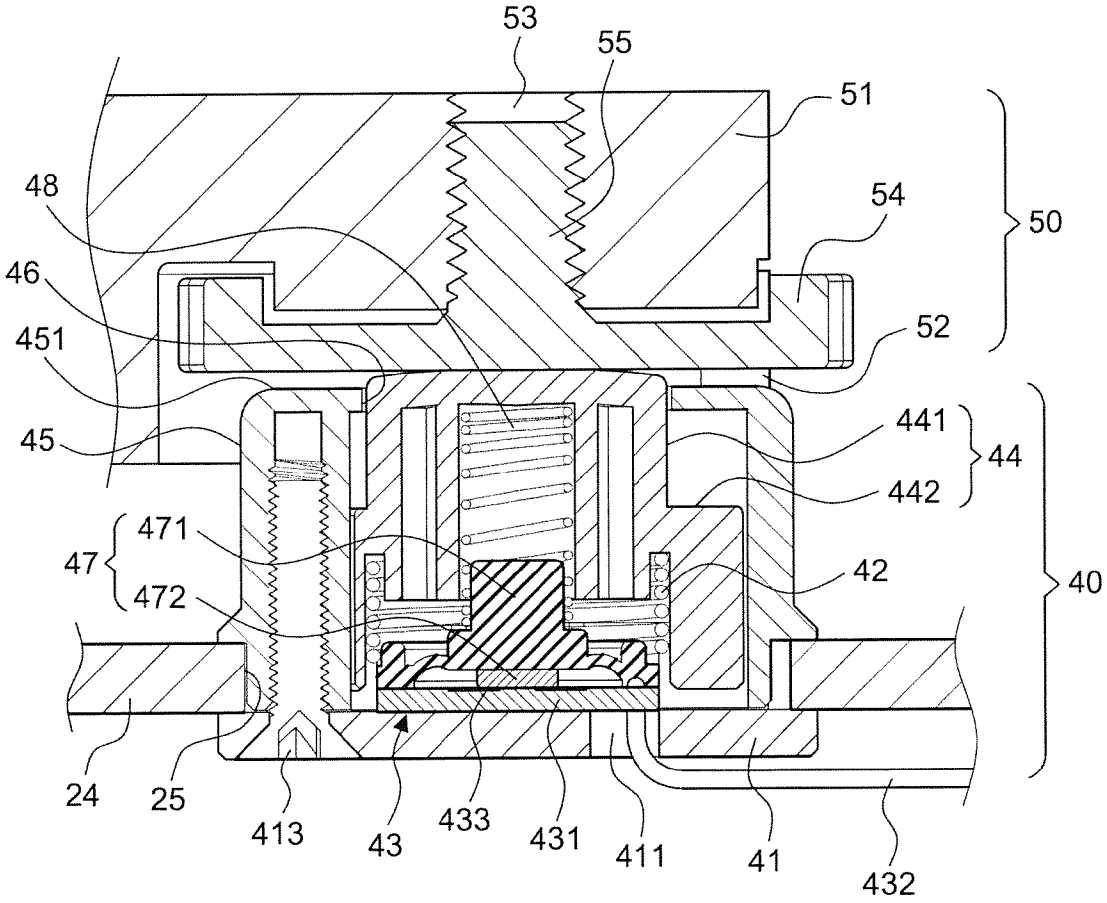
FIG. 9A is an enlarged view of 9A in FIG. 9.

With reference to FIGS. 2 through 11, the present invention discloses an electromagnetic doorlock 60 comprising an electromagnet assembly 20 and an adsorption assembly 30. In the embodiment as shown in FIGS. 8 and 9, the electromagnet assembly 20 is mounted on a door frame 13 and the adsorption assembly 30 is correspondingly mounted on a door plate 14. The electromagnet assembly 20 may also be mounted on a door plate 14 and the adsorption assembly 30 may be correspondingly mounted on a door frame 13. However, the internal structure and external power connection method of the electromagnet assembly and adsorption assembly are prior art and thus will not be described in details here.

The present invention includes an electromagnet assembly 20 that is electronically connected to a button detection module 40 and the adsorption assembly 30 has a pressing member 50 at a side thereof. The electromagnet assembly 20 includes a case 21 and an electric magnet 22 arranged in the case 21. The electric magnet 22 includes a core and a coil around the core to provide an electromagnetic attraction and the case 21 may include a resin coated around the electric magnet 22 or an outer housing; however, it is a prior art and thus will not be described in details here.

Figure 1:
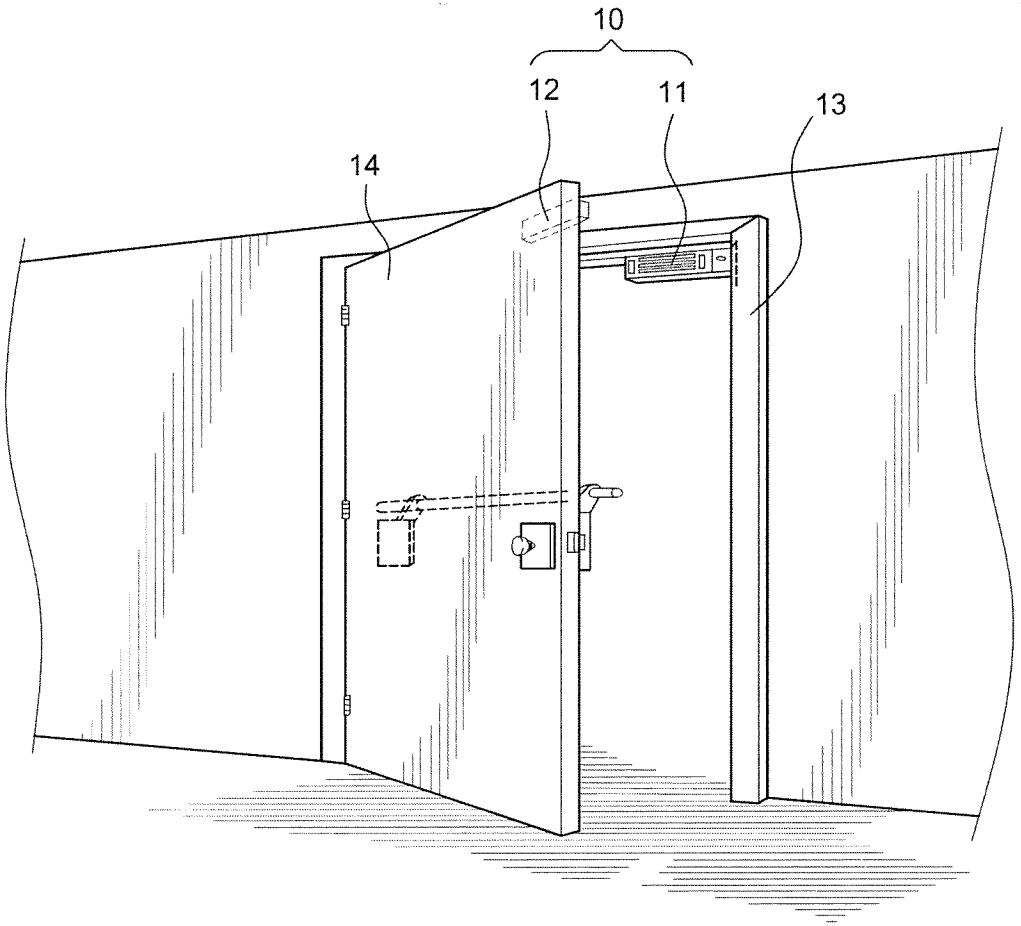
FIG.1 PRIOR ART
FIG. 1 is a schematic view of a conventional electromagnetic door lock.
Figure 2:
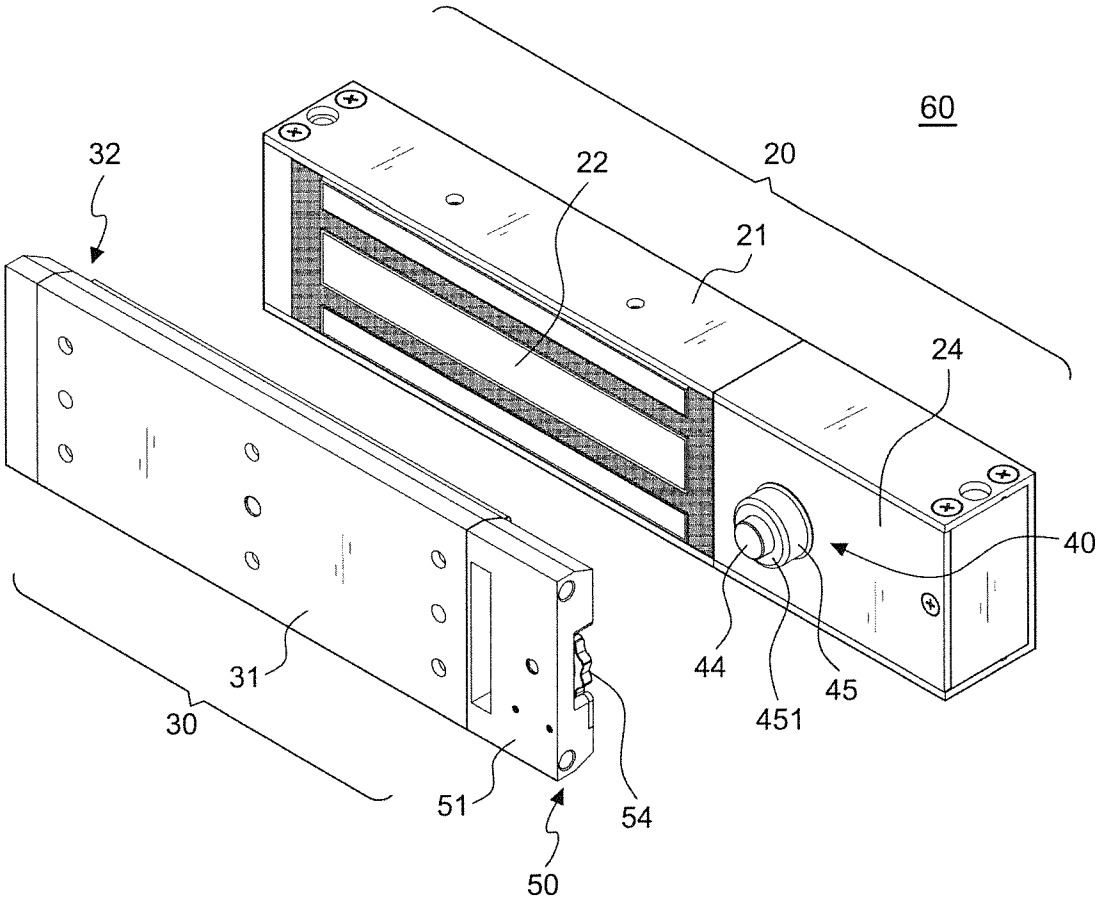
FIG. 2 is a perspective view of the separation of the present invention.
Figure 3:
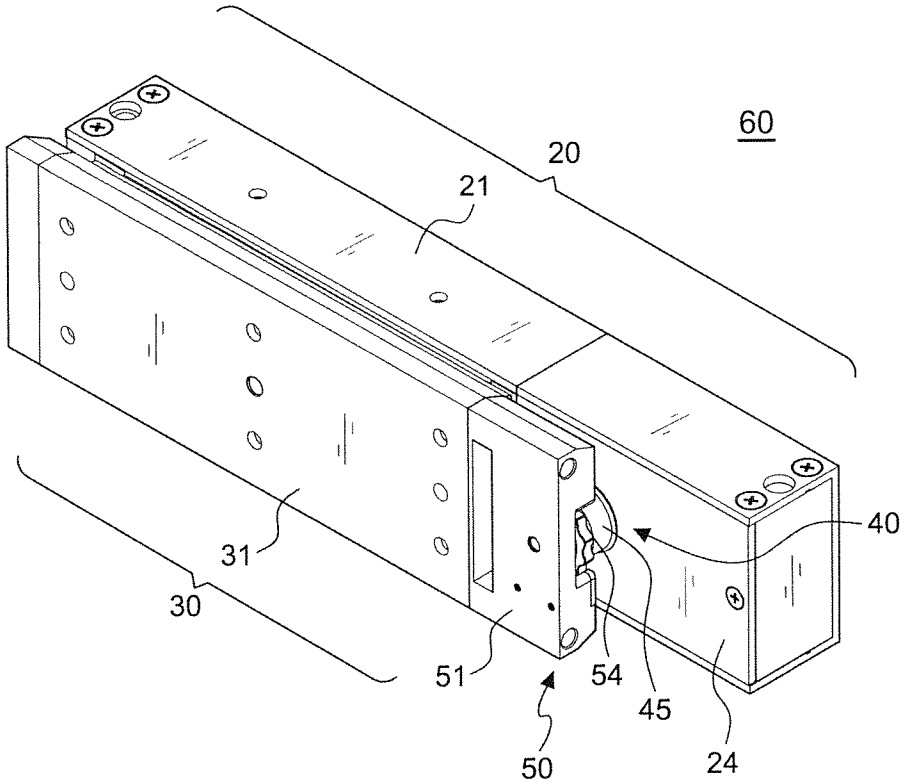
FIG. 3 is a perspective view of the abutment of the present invention.
Figure 4:
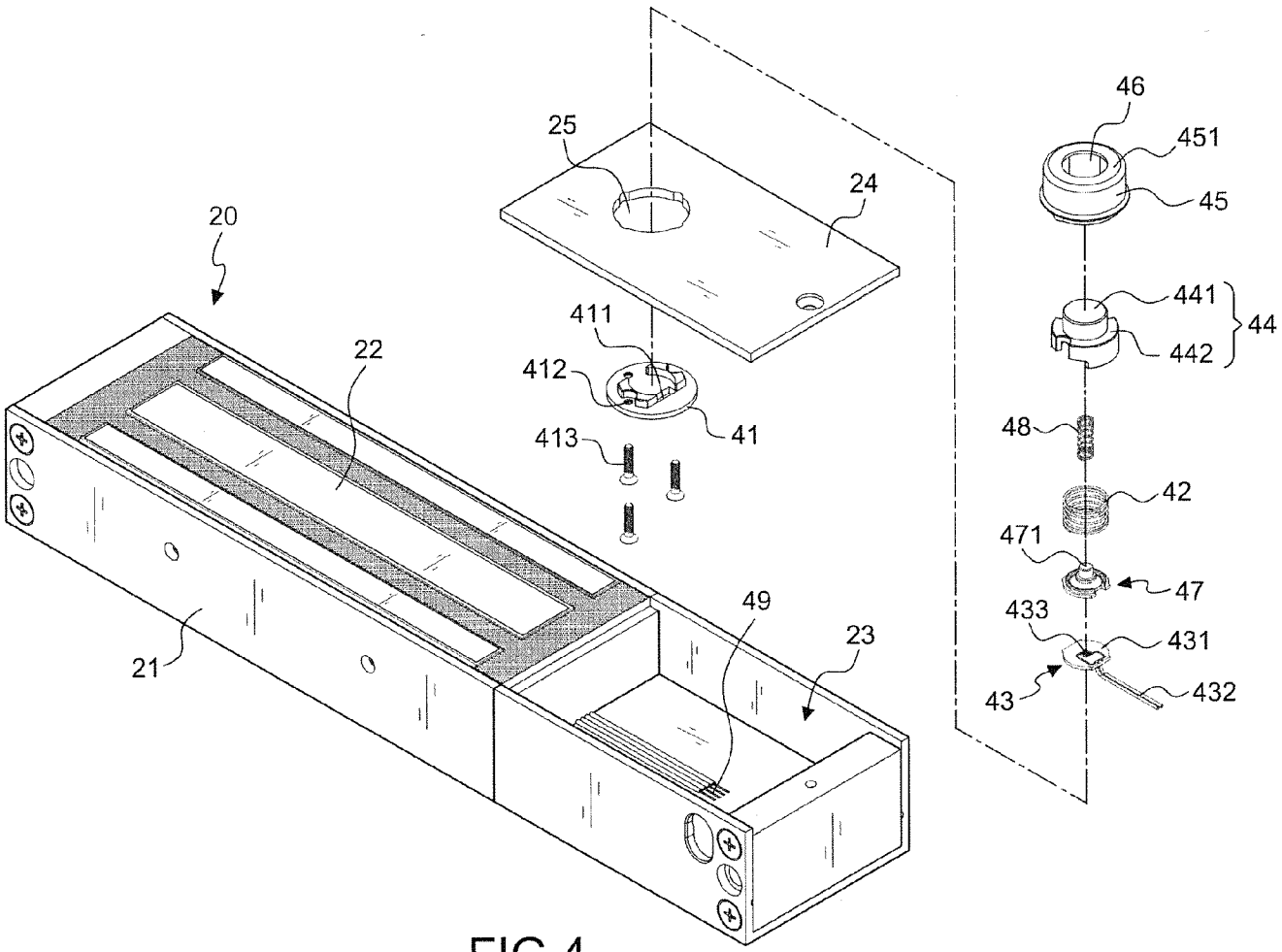
FIG. 4 is a perspective view of the present invention, illustrating the disassembly of the electromagnet assembly.
Figure 5:
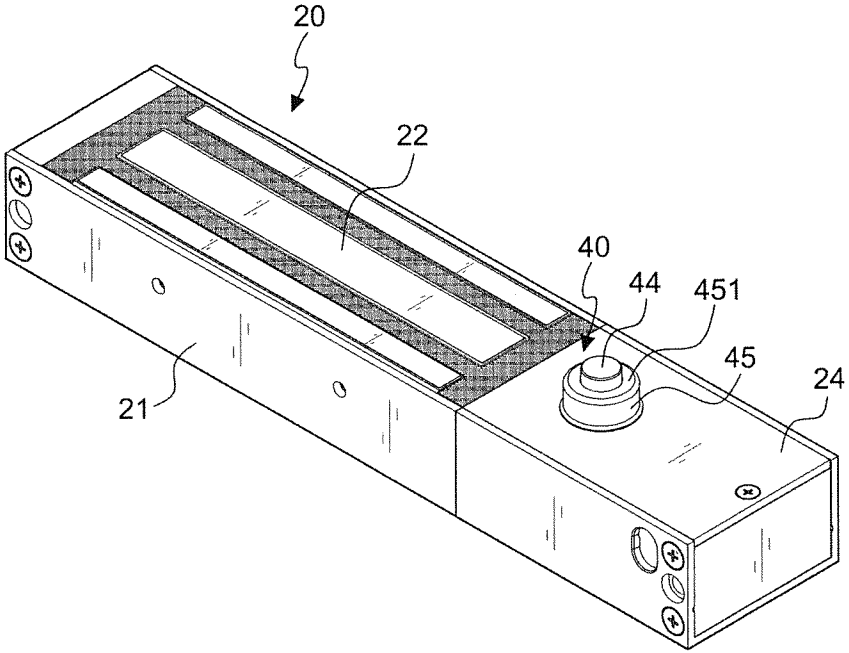
FIG. 5 is a perspective view of the present invention, illustrating the assembly of the electromagnet assembly.

In the preferred embodiment as shown in FIG. 4, the case 21 has a containing room 23 arranged at a side of the electric magnet 22; the containing room 23 has a cover 24 at an opening thereof; the cover 24 includes a mounted hole 25 thereon. Moreover, the containing room 23 may be an independent molding structure mounted on the electromagnet assembly 20 or may be integrally molded with the electromagnet assembly 20. In the embodiment as shown in FIG. 6, the adsorption assembly 30 has a mounted base 31 in a U-shape for placing an adsorption plate 32. The mounted base 31 may be directly molded on the door plate 14. The structure of the adsorption assembly 30 will be described hereafter.

With the reference to FIG. 4, the button detection module 40 is mounted on the mounted hole 25. The button detection module 40 may also be mounted at a predetermined position of a periphery of the electromagnet assembly 20. In the embodiment, the button detection module 40 includes: a base 41, a trigger circuit 43 and a trigger detector 47. The base 41 is upward mounted at a bottom of the mounted hole 25 and fixed by a first screw 413 and the base 41 includes a through hole 411 and several first screw holes 412. In another applicable embodiment, the base 41 may be integrally molded with the cover 24. The trigger circuit 43 may be a circuit board arranged on the base 41 and has an electrical contact 433 on a surface thereof and a side thereof is connected to a wire 432 and a control circuit 49. The trigger detector 47 has a flexible body 471 elastically maintained at a top of the electrical contact 433. The trigger detector 47 is preferred to be made of insulating materials and to have a convex surface. The flexible body 471 can be moved axially and elastically and a bottom edge thereof corresponding to the electrical contact 433 has an electrical trigger 472; that is, the trigger detector 47 may be an independent telescoping button for the corresponding pressing member 50 pressing. The electrical trigger 472 is pressed to the electrical contact 433 of the trigger circuit 43 in order to trigger the control circuit 49 controlling the electric magnet 22 adsorbing the adsorption plate 32 to be in a lock state.

In the preferred embodiment, the button detection module 40 further includes an elastic member 42 arranged on the flexible body 471, an abutment body 44 arranged on the elastic member 42 and having a protrusion portion 441 and a positioning flange 442 at a periphery thereof and a seat 45 fixed on the base 41 and having an axial through hole 46 for containing the abutment body 44 and axially telescoping to provide an upward elastic force for the abutment body 44 by the elastic member 42. In the embodiment, the elastic member 42 of the button detection module 40 is a spring 34 and a small spring 48 is arranged between a bottom edge of the abutment body 44 and the flexible body 471. When the abutment body 44 is moved downward, an elastic force of the small spring 48 presses on an bottom edge of the electrical trigger 472 to contact with the electrical contact 433. In the embodiment, the seat 45 has a bottom mounted in the mounted hole 25.

Figure 8A:
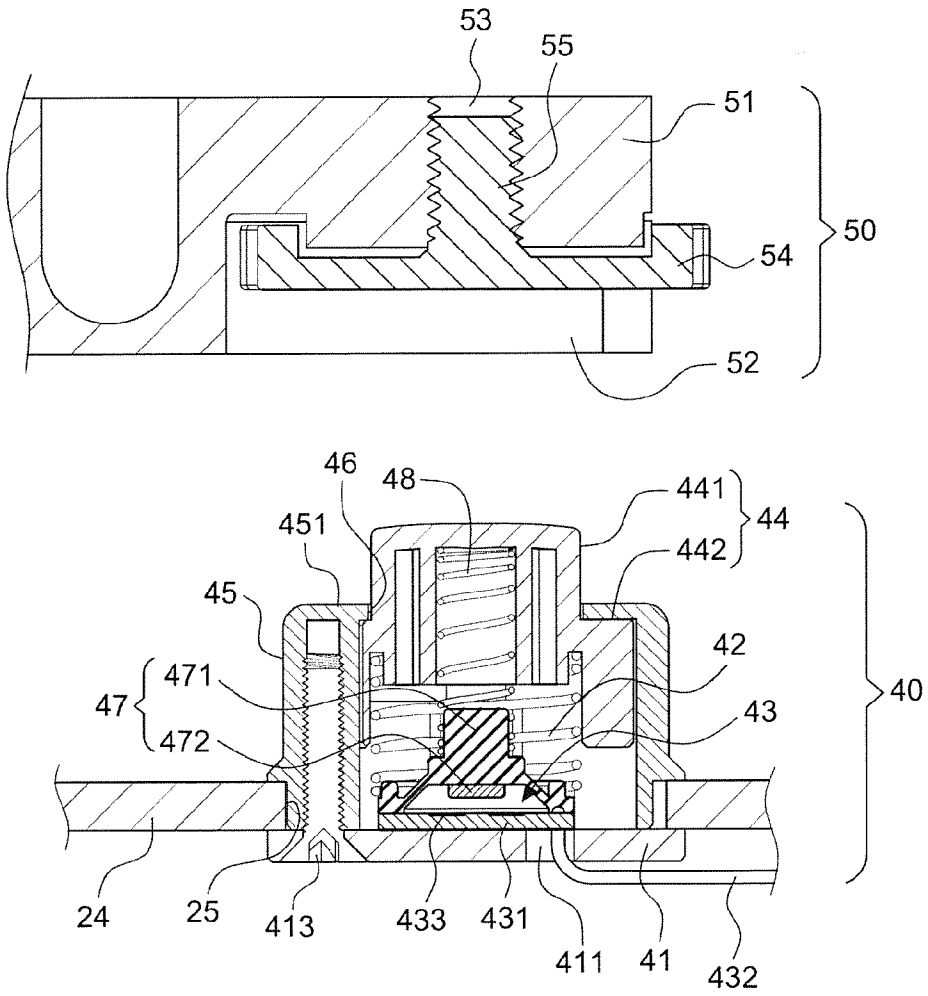
FIG. 8A is an enlarged view of 8A in FIG. 8.

With the referenced to FIG. 8A, the seat 45 has a positioning surface 451 at a periphery of the axial through hole 46 for the positioning flange 442 to be abutted when the protrusion portion 441 of the abutment body 44 is upward pushed by the elastic member 42.

With the referenced to FIGS. 6 and 7, the adsorption assembly 30 mounted at a front side of the electromagnet assembly 20 comprises a mounted base 31, a adsorption plate 32 corresponding to the electric magnet 22 arranged an inner side of the mounted base 31 and has a spot-faced hole 321. The adsorption plate 32 is locked on the mounted base 31 from an inner side thereof through the spot-faced hole 321 by a bolt assembly 33 and a spring 34 is mounted on the bolt assembly 33 for having an elastic displacement space between the inner side of the adsorption plate 32 and the mounted base 31. In another embodiment, the adsorption plate 32 may be mounted on a door plate 14.

Figure 11:
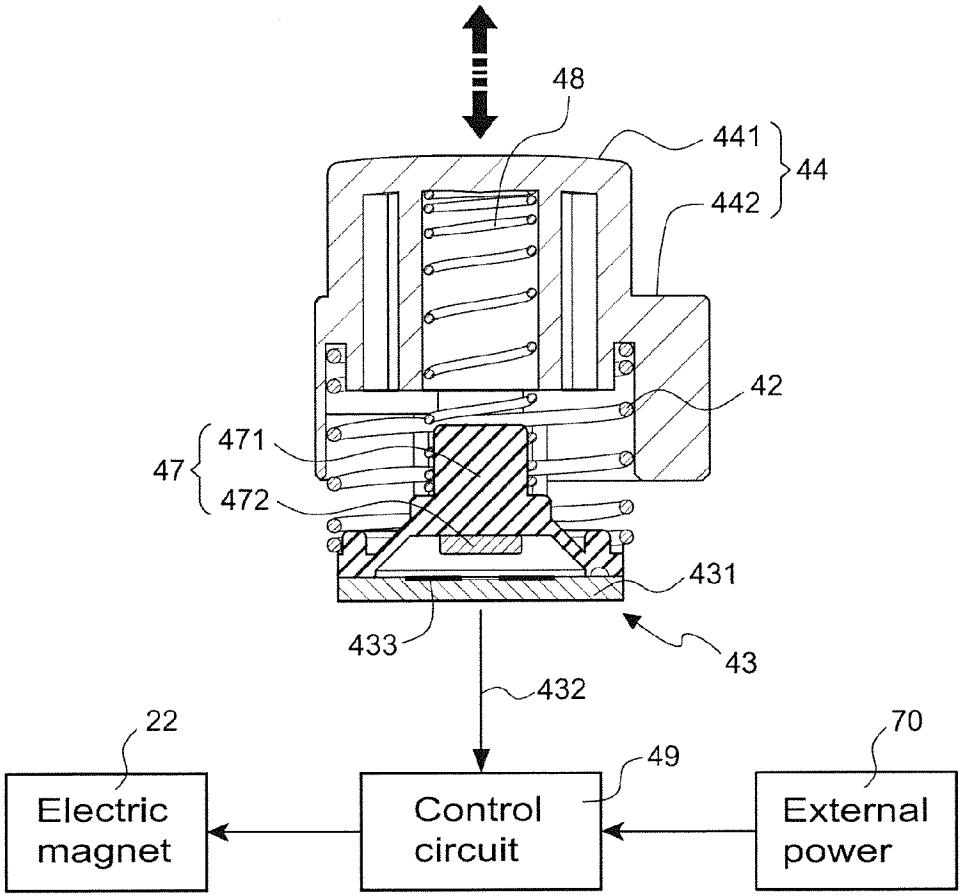
FIG. 11 is a control block view of the present invention.

The pressing member 50 is mounted on a periphery of the adsorption assembly 30. In the embodiment, the pressing member 50 is fixed at a side of the adsorption assembly 30 and includes a base body 51 having a recessed surface 52 with a second screw hole 53 at a center thereof and an abutment button 54 having a front side corresponding to the abutment body 44 of the button detection module 40 and a bottom surface with a second screw 55 for screwing to the second screw hole 53 to adjust a height between the abutment button 54 and a surface of the base body 51 and a pressed degree between the abutment button 54 and the abutment body 44 as shown in FIG. 11. Moreover, a resilient positioning member 511 as shown in FIG. 7 is mounted at a side of the abutment button 54 of the base body 51. The resilient positioning member 511 may be an elastic piece or a flexible steel ball.

With referenced to FIGS. 8, 9 and 11, the control circuit 49 is arranged in the containing room 23 of the electromagnet assembly 20 and an end thereof is connected to an external power 70 and another end is electronically connected to the electric magnet 22 for the power supply to control the power supply to the electric magnet 22.

Based on the features disclosed, when the door plate 14 is opened, the abutment button 54 of the pressing member 50 does not contact with the abutment body 44 on the door frame 13 and the control circuit 49 does not supply the normal power to the electric magnet 22. When the door plate 14 and the door frame 13 are closed together, the abutment button 54 of the pressing member 50 presses to the abutment body 44 of the button detection module 40 and the abutment body 44 drives the flexible body 471 downward displaced for the electrical trigger 472 to contact with the electrical contact 433 of the trigger circuit 43 in order to trigger the control circuit 49 controlling the electric magnet 22 adsorbing the adsorption plate 32 to be in a lock state. When the door plate 14 is still, the present invention goes into a low power adsorption state. In the embodiment, the electrical trigger 472 may be any conductive material which can trigger the electrical contact 433.

Figure 10:
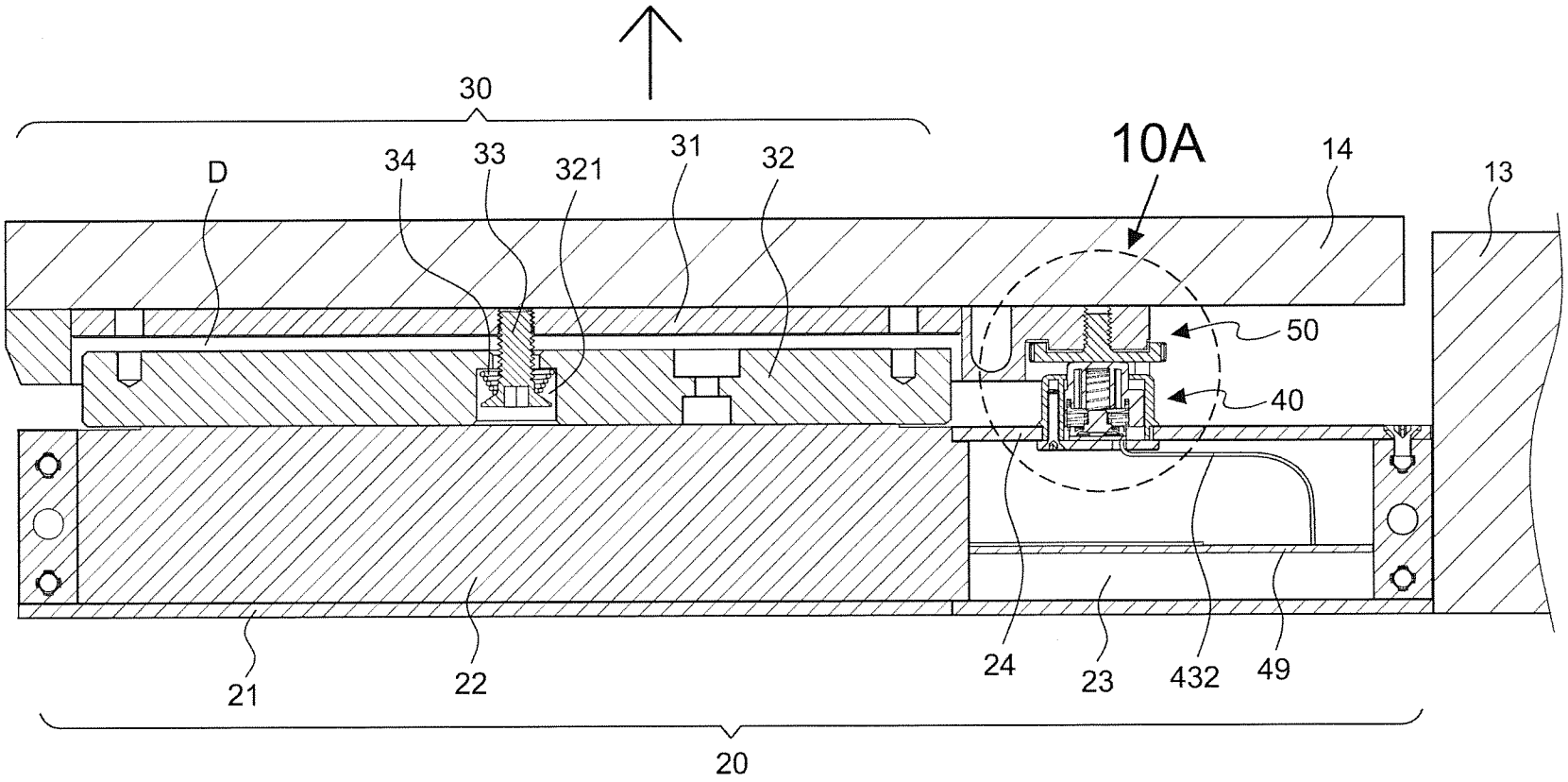
FIG. 10 is a schematic view of the present invention, illustrating the electromagnet and adsorption assemblies are to be separated.
Figure 10A:
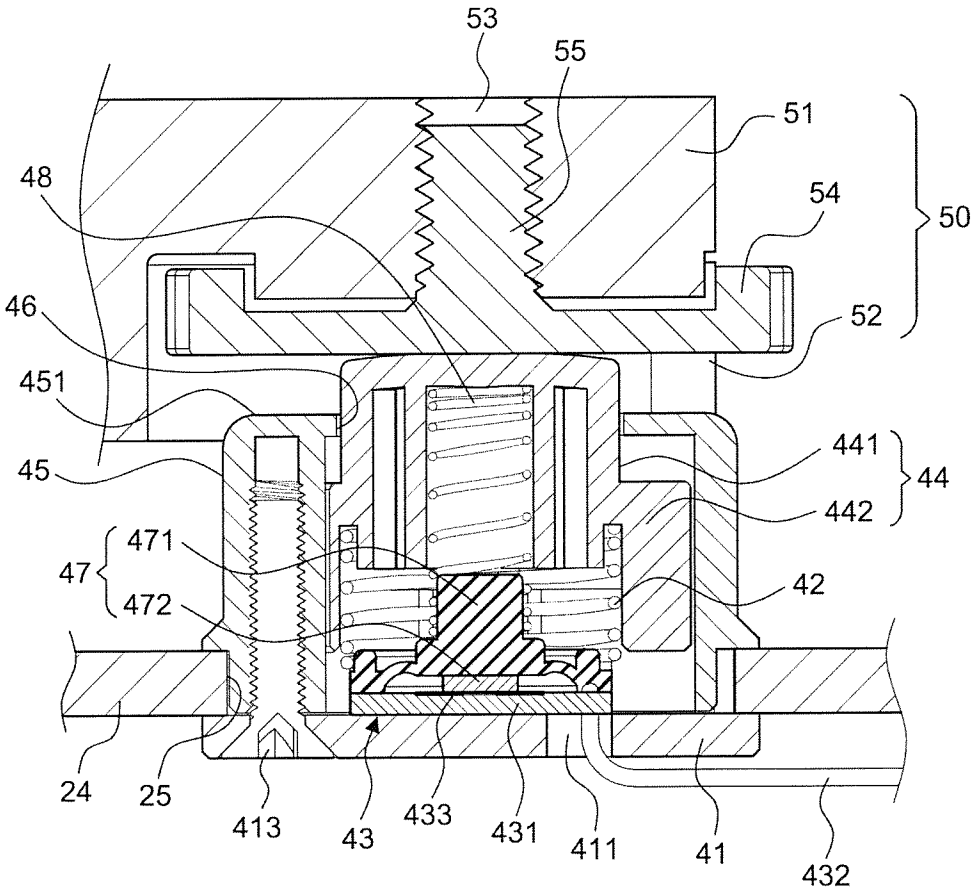
FIG. 10A is an enlarged view of 10A in FIG. 10.

Moreover, the present invention provides the adsorption assembly 30 to assist the button detection module 40 wherein the mounted base 31 is locked on the door plate 14 and the adsorption plate 32 is contact with the corresponding electric magnet 22. With reference to FIG. 9, the electric magnet 22 usually maintains basic adsorption with low power. With reference to FIGS. 10 and 10A, when the door plate 14 is pushed, the adsorption plate 32 is still attracted by the electric magnet 22 and the mounted base 31 is displaced together with the door plate 14 for a small distance D. The spring 34 in the spot-faced hole 321 provides a displacement buffering function such that when the adsorption assembly 30 contacts with the door plate 14, there is enough time for the control circuit 49 to send the normal current to the electric magnet 22 in order to achieve the safety purpose. To achieve the same purpose, the bolt assembly and spring assembly may be installed in the electromagnet assembly to form the elastic displacement space between the inner side of the electromagnet assembly and the door frame.

Therefore, the abutment body 44 and the trigger detector 47 are set to be a touchtone axial linkage such that when the door plate 14 is instantly displaced, the flexible body 471 moves upward to separate the electrical trigger 472 and the electrical contact 433 for the trigger circuit 43 rapidly reacting; before the door plate 14 has been pushed and opened, the present invention returns to normal current supply, achieving the desired safety purpose. For example, if the electromagnetic door lock 60 requires 1200 pounds of electromagnetic attraction to stay in the lock state, the electromagnetic door lock 60 requires 500 mA current. Moreover, to maintain normal power supply for 24 hours, the power consumption is considerable. For this reason, the present invention provides small current such as 100 mA for the electric magnet 22 when the door plate 14 is still and closed such that the electromagnetic door lock 60 produces small attraction to attract the adsorption plate 32. When people push or destroy the door, the trigger circuit 43 reacts rapidly to return to the normal power supply and stay in a lock state with normal current, achieving access control security and saving power.

What is claimed is:

1. An electromagnetic doorlock with button detection and power saving device, comprising:

an electromagnet assembly having an electric magnet with electromagnetic attraction and an adsorption assembly arranged on a corresponding surface thereof;

wherein the electromagnet assembly is electrically connected to a button detection module and the button detection module includes: a base, a trigger circuit on the base having an electrical contact on a surface thereof, the electrical contact electrically connected to a control circuit, and a trigger detector having an elastically deformable body maintaining a biasing force separating the electrical contact and an electrical trigger for moving the electrical trigger axially in dampened manner to contact the electrical contact and thereby selectively open and close the trigger circuit;

wherein the button detection module further includes an elastic member arranged on the elastically deformable body;

the adsorption assembly including: an adsorption plate locked on a door plate by a bolt assembly and a spring mounted on the bolt assembly for having an elastic displacement space between an inner side of the adsorption plate and the door plate;

a pressing member arranged at a periphery of the adsorption assembly and having a front side pressing on the elastically deformable body of the button detection module;

wherein during closure of a door, the adsorption assembly is attracted by the electromagnetic attraction of the electromagnet assembly and the button detection module is pressed by the pressing member; when the door is closed and still, the electromagnetic doorlock is in a low power attraction state; when the door is moved by an external action, the button detection module is triggered so that the electromagnetic doorlock rapidly returns to a normal lock state with normal current supply.

2. The electromagnetic doorlock with button detection and power saving device as claimed in claim 1, wherein the button detection module further includes an abutment body arranged on the elastic member and having a protrusion portion and a positioning flange at a periphery thereof and a seat fixed on the base and having an axial through hole for containing the abutment body and axially extending to provide an upward elastic force for the abutment body by the elastic member.

3. The electromagnetic doorlock with button detection and power saving device as claimed in claim 2, wherein the electromagnet assembly is arranged on a door frame and the adsorption assembly is correspondingly arranged on the door plate; the electromagnet assembly has a containing room with a cover at an opening thereof; the cover has a mounted hole thereon and the button detection module is mounted on the mounted hole.

4. The electromagnetic doorlock with button detection and power saving device as claimed in claim 3, wherein the containing room may be an independent molding structure mounted on the electromagnet assembly or may be integrally molded with the electromagnet assembly.

5. The electromagnetic doorlock with button detection and power saving device as claimed in claim 4 further comprises a small spring arranged between a bottom edge of the abutment body and the elastically deformable body.

6. The electromagnetic doorlock with button detection and power saving device as claimed in claim 5, wherein the seat of the button detection module has a positioning surface at a periphery of the axial through hole for the positioning flange to abut when the protrusion portion of the abutment body is upward pushed by the elastic member.

7. The electromagnetic doorlock with button detection and power saving device as claimed in claim 6, wherein the control circuit is arranged in the containing room of the electromagnet assembly and an end thereof is connected to an external power supply and another end is electronically connected to the electric magnet to control the external power supply to the electric magnet.

8. The electromagnetic doorlock with button detection and power saving device as claimed in claim 2, wherein the adsorption assembly includes a spot-faced hole and is locked on the door plate from an inner side thereof through the spot-faced hole by the bolt assembly and the adsorption plate of the adsorption assembly is locked on a mounted base or directly on the door plate.

9. The electromagnetic doorlock with button detection and power saving device as claimed in claim 2, wherein the trigger circuit is a circuit board.

10. The electromagnetic doorlock with button detection and power saving device as claimed in claim 2, wherein the elastic member of the button detection module is a spring.

11. The electromagnetic doorlock with button detection and power saving device as claimed in claim 2, wherein the pressing member includes: a base body having a recessed surface with a second screw hole at a center thereof; and an abutment button having a front side facing to the abutment body of the button detection module and a bottom surface with a second screw for screwing to the second screw hole to adjust a height between the abutment button and a surface of the base body.

12. An electromagnetic doorlock with button detection and power saving device, comprising:

an electromagnet assembly having an electric magnet with electromagnetic attraction and an adsorption assembly arranged on a corresponding surface thereof;

wherein the electromagnet assembly is electrically connected to a button detection module and the button detection module includes: a base, a trigger circuit on the base having an electrical contact on a surface thereof, the electrical contact electrically connected to a control circuit, and a trigger detector having a flexible body elastically maintained at a top of the electrical contact for moving axially and corresponding to the electrical contact having an electrical trigger;

the adsorption assembly including an adsorption plate locked on a door plate by a bolt assembly and a spring mounted on the bolt assembly for having an elastic displacement space between an inner side of the adsorption plate and the door plate;

a pressing member arranged at a periphery of the adsorption assembly and having a front side pressing on the flexible body of the button detection module;

wherein during closure of a door, the adsorption assembly is attracted by the electromagnetic attraction of the electromagnet assembly and the button detection module is pressed by the pressing member; when the door is closed and still, the electromagnetic doorlock is in a low power attraction state; when the door is moved by an external action, the button detection module is triggered so that the electromagnetic doorlock rapidly returns to a normal lock state with normal current supply, wherein the button detection module further includes an elastic member arranged on the flexible body, an abutment body arranged on the elastic member and having a protrusion portion and a positioning flange at a periphery thereof and a seat fixed on the base and having an axial through hole for containing the abutment body and axially extending to provide an upward elastic force for the abutment body by the elastic member, the electromagnet assembly is arranged on a door frame and the adsorption assembly is correspondingly arranged on the door plate; the electromagnet assembly has a containing room with a cover at an opening thereof, the cover has a mounted hole thereon and the button detection module is mounted on the mounted hole, the containing room is selected from: an independent molding structure mounted on the electromagnet assembly and integrally molded with the electromagnet assembly, and a small spring is arranged between a bottom edge of the abutment body and the flexible body.

* * * * *